US007314091B2

(12) United States Patent
Wagner et al.

(10) Patent No.: US 7,314,091 B2
(45) Date of Patent: Jan. 1, 2008

(54) CEMENT-THROUGH, TUBING RETRIEVABLE SAFETY VALVE

(75) Inventors: Nathaniel Heath Wagner, Spring, TX (US); George C. Duncan, Houston, TX (US); Roddie R. Smith, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 267 days.

(21) Appl. No.: 10/853,568

(22) Filed: May 25, 2004

(65) Prior Publication Data

US 2005/0061519 A1 Mar. 24, 2005

Related U.S. Application Data

(60) Provisional application No. 60/505,515, filed on Sep. 24, 2003.

(51) Int. Cl.
*E21B 34/06* (2006.01)

(52) U.S. Cl. ..... 166/386; 166/332.8

(58) Field of Classification Search ..... 166/332.1, 166/332.8, 334.1
See application file for complete search history.

(56) References Cited

U.S. PATENT DOCUMENTS 3,955,623 A * 5/1976 Aumann ..... 166/340
4,577,694 A * 3/1986 Brakhage, Jr. ..... 166/382
4,624,315 A 11/1986 Dickson et al.
4,796,705 A * 1/1989 Carmody et al. ..... 166/323
4,834,183 A 5/1989 Vinzant et al.
4,945,993 A 8/1990 Dickson et al.
5,145,005 A 9/1992 Dollison
5,167,284 A 12/1992 Leismer
5,199,494 A 4/1993 Williamson, Jr.
5,249,630 A 10/1993 Meaders et al.
5,259,457 A 11/1993 Williamson, Jr.
5,293,943 A 3/1994 Williamson, Jr.
5,343,955 A 9/1994 Williams
5,564,502 A 10/1996 Crow et al.
5,682,921 A 11/1997 Rawswon et al.
5,799,949 A 9/1998 Beall et al.

(Continued)

FOREIGN PATENT DOCUMENTS

WO WO 03/054347 7/2003

OTHER PUBLICATIONS

U.S. Appl. No. 10/366,593; Entitled: "Subsurface Safety Valve;" filed Feb. 12, 2003.

(Continued)

*Primary Examiner*—Frank Tsay
(74) *Attorney, Agent, or Firm*—Patterson & Sheridan, L.L.P.

(57) ABSTRACT

A subsurface safety valve is first provided. The safety valve generally comprises a tubular housing, an isolation sleeve disposed within an inner diameter of the tubular housing, with the isolation sleeve and the tubular body forming an annular area there between, a flow tube movably disposed along a portion of the annular area, and a flapper. The flapper is pivotally movable between an open position and a closed position in response to longitudinal movement of the flow tube in order to open and close the valve. Preferably, the annular area is isolated from an inner diameter of the isolation sleeve in the open position. A method is also provided that allows for a cementing operation to be performed through an open safety valve.

31 Claims, 5 Drawing Sheets

U.S. PATENT DOCUMENTS

| | | | |
|---|---|---|---|
| 5,823,265 | A | 10/1998 | Crow et al. |
| 5,918,858 | A | 7/1999 | Rawson et al. |
| 6,056,055 | A | 5/2000 | Falconer et al. |
| 6,109,351 | A | 8/2000 | Beall |
| 6,173,785 | B1 | 1/2001 | Adams et al. |
| 6,260,850 | B1 | 7/2001 | Beall et al. |
| 6,283,477 | B1 | 9/2001 | Beall et al. |
| 6,296,061 | B1 | 10/2001 | Leismer |
| 6,302,210 | B1 | 10/2001 | Crow et al. |
| 6,328,062 | B1 | 12/2001 | Williams et al. |
| 6,659,185 | B2 | 12/2003 | Dennistoun et al. |
| 6,732,803 | B2 | 5/2004 | Garcia et al. |
| 2003/0205389 | A1 | 11/2003 | Deaton et al. |
| 2004/0020636 | A1 | 2/2004 | Kenison et al. |
| 2004/0026087 | A1 | 2/2004 | Dennistoun et al. |
| 2004/0154803 | A1 | 8/2004 | Anderson et al. |
| 2005/0016734 | A1 | 1/2005 | Thompson |

OTHER PUBLICATIONS

Halliburton Energy Services, Inc.; WellStar™; Tubing Retrievable Subsurface Safety Valve; 4 pp.; (1997).

Halliburton Energy Services, Inc.; product brochure for WellStar@ Tubing-Retrievable Safety Valve; pp. 6-13 (2004).

EP Search Report, Application No. 04022396.8-2315, dated Nov. 17, 2004.

CA Examination Report, Application No.: 2,482,290, Dated Aug. 11, 2006.

* cited by examiner

CEMENT-THROUGH, TUBING RETRIEVABLE SAFETY VALVE

CROSS-REFERENCE TO RELATED APPLICATIONS

This application claims benefit of U.S. provisional patent application Ser. No. 60/505,515, filed Sep. 24, 2003, which is incorporated by reference herein in its entirety. That application is entitled "Tubing Mounted Safety Valve."

BACKGROUND OF THE INVENTION

1. Field of the Inventions

Embodiments of the present invention are generally related to safety valves. More particularly, embodiments of the invention pertain to subsurface safety valves configured to permit a cementing operation of a wellbore there through.

2. Description of the Related Art

Surface-controlled, subsurface safety valves (SCSSVs) are commonly used to shut-in oil and gas wells. Such SCSSVs are typically fitted into a production tubing in a hydrocarbon producing well, and operate to selectively block the flow of formation fluids upwardly through the production tubing should a failure or hazardous condition occur at the well surface.

SCSSVs are typically configured as rigidly connected to the production tubing (tubing retrievable), or may be installed and retrieved by wireline without disturbing the production tubing (wireline retrievable). During normal production, the subsurface safety valve is maintained in an open position by the application of hydraulic fluid pressure transmitted to an actuating mechanism. The actuating mechanism in one embodiment is charged by application of hydraulic pressure. The hydraulic pressure is commonly a clean oil supplied from a surface fluid reservoir through a control line. A pump at the surface delivers regulated hydraulic fluid under pressure from the surface to the actuating mechanism through the control line. The control line resides within the annular region between the production tubing and the surrounding well casing.

Where a failure or hazardous condition occurs at the well surface, fluid communication between the surface reservoir and the control line is broke. This, in turn, breaks the application of hydraulic pressure against the actuating mechanism. The actuating mechanism recedes within the valve, allowing the flapper to close against an annular seat quickly and with great force.

Most surface controlled subsurface safety valves are "normally closed" valves, i.e., the valve is in its closed position when the hydraulic pressure is not present. The hydraulic pressure typically works against a powerful spring and/or gas charge acting through a piston. In many commercially available valve systems, the power spring is overcome by hydraulic pressure acting against the piston, producing longitudinal movement of the piston. The piston, in turn, acts against an elongated "flow tube." In this manner, the actuating mechanism is a hydraulically actuated and longitudinally movable piston that acts against the flow tube to move it downward within the tubing and across the flapper.

During well production, the flapper is maintained in the open position by force of the piston acting against the flow tube downhole. Hydraulic fluid is pumped into a variable volume pressure chamber (or cylinder) and acts against a seal area on the piston. The piston, in turn, acts against the flow tube to selectively open the flapper member in the valve. Any loss of hydraulic pressure in the control line causes the piston and actuated flow tube to retract. This, in turn, causes the flapper to rotate about a hinge pin to its valve-closed position. In this manner, the SCSSV is able to provide a shutoff of production flow within the tubing as the hydraulic pressure in the control line is released.

During well completions, certain cement operations can create a dilemma for the operator. In this respect, the pumping of cement down the production tubing and through the SCSSV presents the risk of damaging the valve. Operative parts of the valve, such as the flow tube or flapper, could become cemented into place and inoperative. At the least, particulates from the cementing fluid could invade chamber areas in the valve and cause the valve to become inoperable.

In an attempt to overcome this possibility, the voids within the valve have been liberally filled with grease or other heavy viscous material. The viscous material limits displacement of cement into the operating parts of the valve. In addition to grease packing, an isolation sleeve may be used to temporarily straddle the inner diameter of the valve and seal off the polished bore portion along the safety valve. However, this procedure requires additional trips to install the sleeve before cementing, and then later remove the sleeve at completion.

Therefore, a need exists for an apparatus and improved method for protecting the SCSSV from cement infiltrating the inner mechanisms of the valve during a cementing operation. There is a further need for an improved SCSSV that does not require elastomeric seals to seal off the flow tube or other operative parts of the safety valve during a cement-through operation. Still further, there is a need for an improved SCSSV that isolates certain parts of the valve from cement infiltration during a cement-through operation, without unduly restricting the inner diameter of the safety valve for later operations.

SUMMARY OF THE INVENTION

A subsurface safety valve is first provided. The safety valve has a longitudinal bore there through. The safety valve generally comprises a tubular housing, a tubular isolation sleeve disposed within an inner diameter of the tubular housing, with the isolation sleeve and the tubular body forming an annular area there between, a flow tube movably disposed along a portion of the annular area, and a flapper. The flapper is pivotally movable between an open position and a closed position in response to longitudinal movement of the flow tube in order to selectively open and close the valve. Preferably, the annular area is isolated from an inner diameter of the isolation sleeve. In one embodiment, a seal ring is placed along an outer diameter of the isolation sleeve for sealingly receiving the movable flow tube and for providing the isolation of the annular area. Preferably, the isolation sleeve is stationary.

In operation, the valve permits fluid to flow through the inner diameter of the isolation sleeve when the flapper is in the open position, but the valve is sealed to fluid flow when the flapper is in the closed position.

In one embodiment, the safety valve further includes a piston disposed above the flow tube, wherein the piston acts against the flow tube in response to hydraulic pressure in order to move the flow tube longitudinally. Preferably, the valve also includes a biasing member acting against the piston in order to bias the piston and connected flow tube to allow the flapper to close. An example of a biasing member is a spring. The piston may be either a rod piston or a concentric annular piston.

A method for controlling fluid flow in a wellbore is also provided. In one embodiment, the method includes the steps of placing a safety valve in series with a string of production tubing. The production tubing has a bore there through, and the safety valve may be as described above. The method also includes the steps of running the production tubing and safety valve into the wellbore, placing the flapper in its open position, and pumping cement into the bore of the production tubing and through the safety valve. In one embodiment, the method also includes further pumping cement into an annulus formed between the production tubing and the surrounding wellbore to form a cement column, thereby securing the production tubing in the wellbore, providing fluid communication between the bore of the tubing and a selected formation along the wellbore, and producing the well by allowing hydrocarbons to flow through the production tubing and the opened safety valve. Preferably, the step of providing fluid communication between the bore of the tubing and a selected formation along the wellbore is accomplished through use of a perforating gun.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
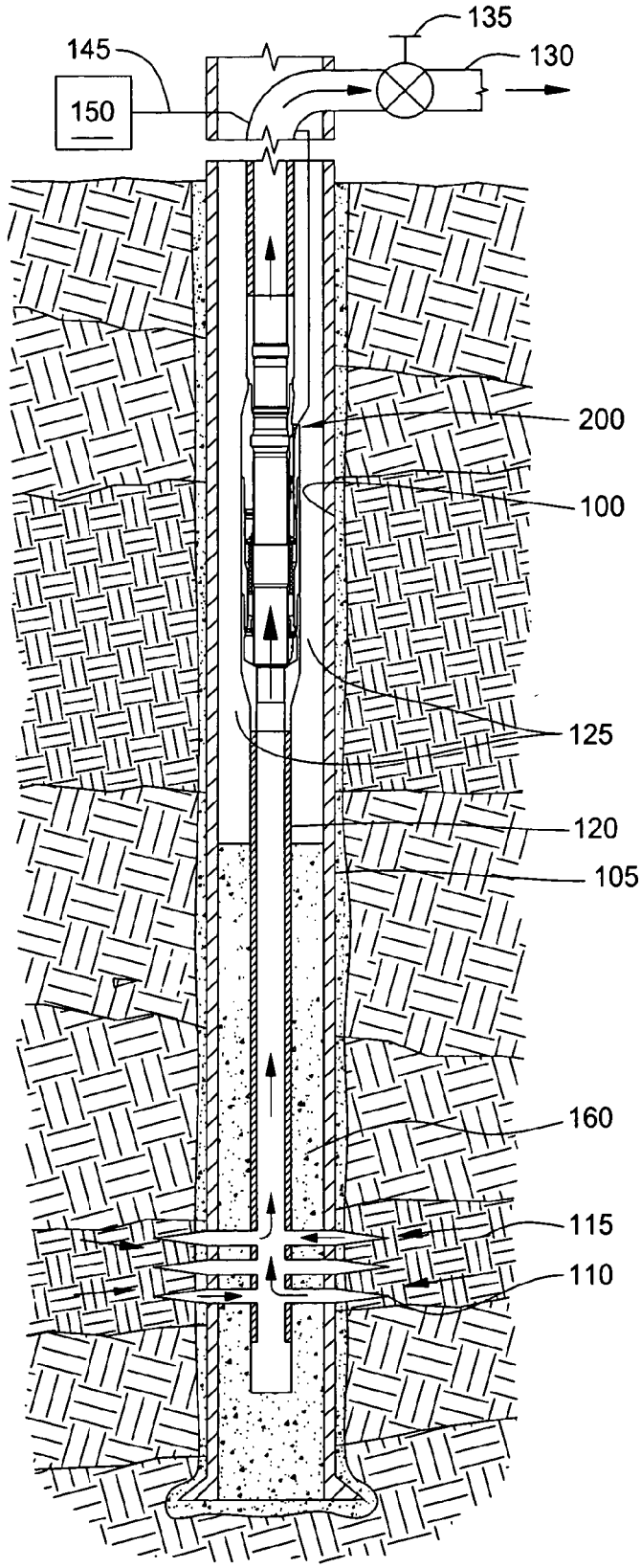
FIG. 1 is a cross-sectional view of a wellbore illustrating a production tubing having a safety valve in accordance with an embodiment of the present invention.

The present invention is generally directed to a tubing-retrievable subsurface safety valve for controlling fluid flow in a wellbore. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features described below. One of normal skill in the art of subsurface safety valves will appreciate that the various embodiments of the invention can and may be used in all types of subsurface safety valves, including but not limited to tubing retrievable, wireline retrievable, injection valves, or subsurface controlled valves.

For ease of explanation, the invention will be described generally in relation to a cased vertical wellbore. It is to be understood; however, that the invention may be employed in an open wellbore, a horizontal wellbore, or a lateral wellbore without departing from principles of the present invention. Furthermore, a land well is shown for the purpose of illustration; however, it is understood that the invention may also be employed in offshore wells or extended reach wells that are drilled on land but completed below an ocean or lake shelf.

FIG. 1 presents a cross-sectional view of an illustrative wellbore 100. The wellbore is completed with a string of production tubing 120 therein. The production tubing 120 defines an elongated bore through which fluids may be pumped downward, or pumped or otherwise produced upward. The production tubing 120 includes a safety valve 200 in accordance with an embodiment of the present invention. The safety valve 200 is used for selectively controlling the flow of fluid in the production tubing 120. The valve 200 may be moved between an open position and closed position by operating a control 150 in communication with the valve 200 through a line 145. The operation of the valve 200 is described in greater detail below in connection with FIGS. 2–5.

During the completion operation, the wellbore 100 is lined with a string of casing 105. Thereafter, the production tubing 120 with the safety valve 200 disposed in series is deployed in the wellbore 100 to a predetermined depth. In connection with the completion operation, the production tubing 120 is cemented in situ. To accomplish this, a column of cement is pumped downward through the bore of the production tubing 120. Cement is urged under pressure through the open safety valve 200, through the bore of the tubing 120, and then into an annulus 125 formed between the tubing 120 and the surrounding casing 105. Preferably, the cement 160 will fill the annulus 125 to a predetermined height, which is proximate to or higher than a desired zone of interest in an adjacent formation 115.

After the cement 160 is cured, the formation 115 is opened to the bore of the production tubing 120 at the zone of interest. Typically, perforation guns (not shown) are lowered through the production tubing 120 and the valve 200 to a desired location proximate the formation 115. Thereafter, the perforation guns are activated to form a plurality of perforations 110, thereby establishing fluid communication between the formation 115 and the production tubing 120. The perforation guns can be removed or dropped off into the bottom of the wellbore below the perforations. Hydrocarbons (illustrated by arrows) may subsequently flow into the production tubing 120, through the open safety valve 200, through a valve 135 at the surface, and out into a production flow line 130.

During this operation, the valve 200 preferably remains in the open position. However, the flow of hydrocarbons may be stopped at any time during the production operation by switching the valve 200 from the open position to the closed position. This may be accomplished either intentionally by having the operator remove the hydraulic pressure applied through the control line 145, or through a catastrophic event at the surface such as an act of terrorism. The valve 200 is demonstrated in its open and closed positions in connection with FIGS. 2–5.

Figure 2:
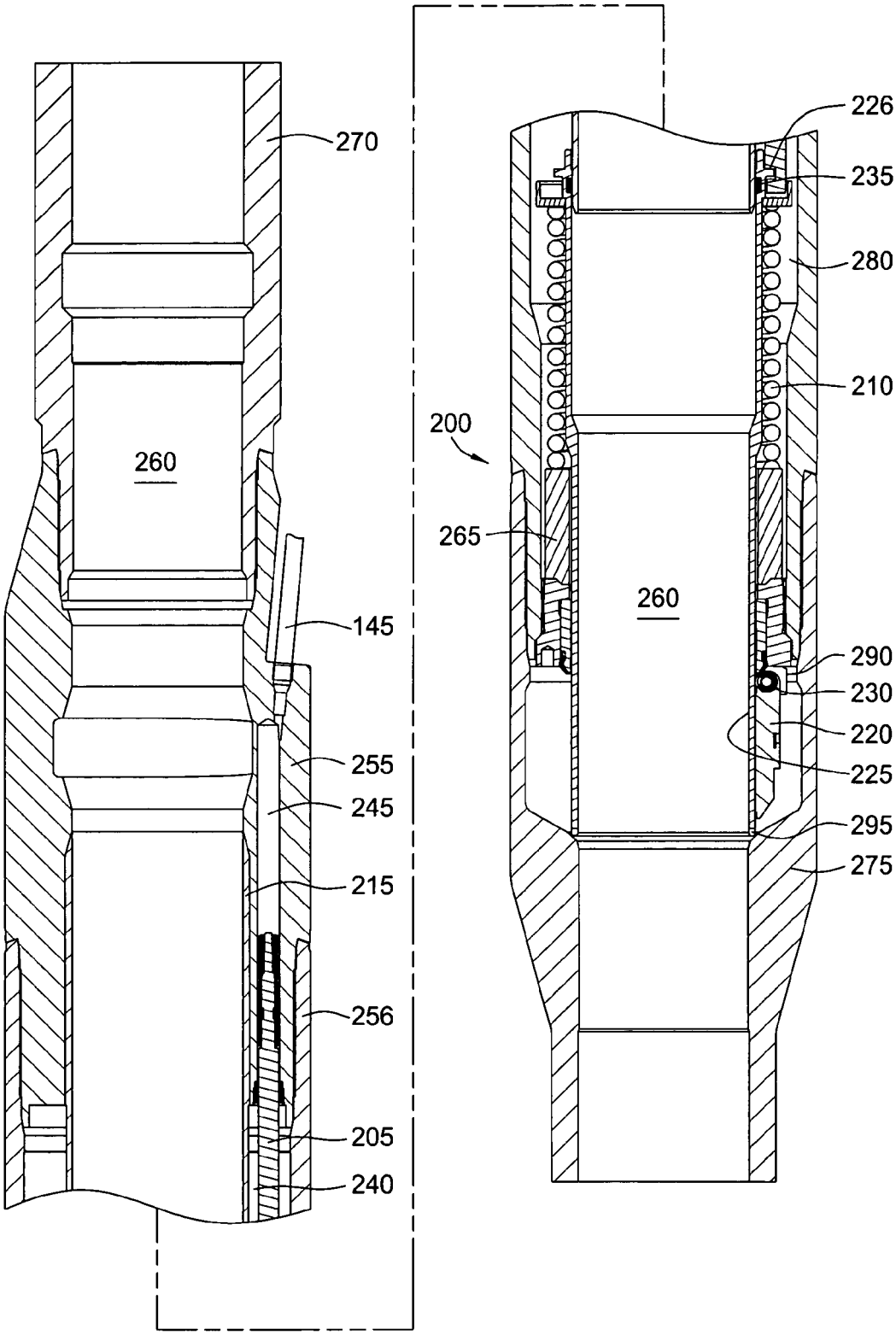
FIG. 2 provides a cross-sectional view of a tubing-retrievable safety valve, in one embodiment. Here, the safety valve is in its open position.

FIG. 2 presents a cross-sectional view illustrating the safety valve 200 in its open position. A bore 260 in the valve 200 allows fluids such as uncured cement to flow down through the valve 200 during the completion operation. In a similar manner, the open valve 200 allows hydrocarbons to flow up through the valve 200 during a normal production operation.

The illustrative valve 200 includes a top sub 270 and a bottom sub 275. The top 270 and bottom 275 subs are threadedly connected in series with the production tubing (shown in FIG. 1). The valve 200 further includes a housing 255 disposed intermediate the top 270 and bottom 275 subs. The housing 255 defines a tubular body that serves as a housing for the valve 200. The tubular housing 255 preferably includes a chamber 245 in fluid communication with a hydraulic control line 145. The hydraulic control line 145 carries fluid such as a clean oil from the control reservoir 150 down to the chamber 245.

In the arrangement of FIG. 2, the chamber 245 is configured to receive a piston 205. The piston 205 typically defines a small diameter piston which is movable within the chamber 245 between an upper position and a lower position. Movement of the piston 205 is in response to hydraulic pressure from the line 145. It is within the scope of the present invention, however, to employ other less common actuators such as electric solenoid actuators, motorized gear drives, and gas charged valves (not shown). Any of these known or contemplated means of actuating the subsurface safety valve 200 of the present invention may be employed.

Figure 4:
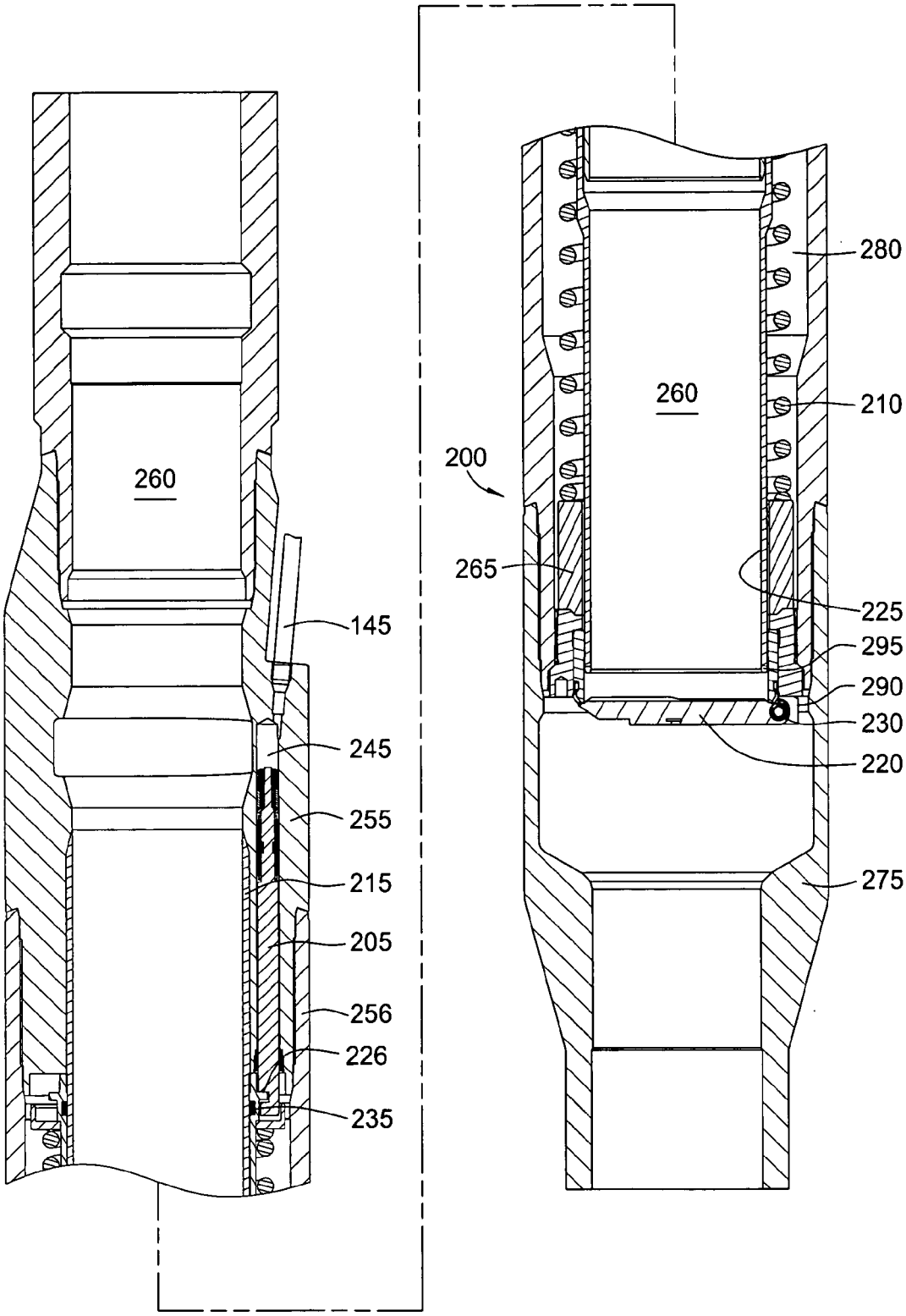
FIG. 4 is a cross-sectional view illustrating the tubing-retrievable safety valve of FIG. 2 in a closed position.

As illustrated in FIG. 2, the valve 200 also may include a biasing member 210. Preferably, the biasing member 210 defines a spring 210. The spring 210 resides in the tubular body 255 below the piston 205. In one optional aspect, the lower portion of the tubular body 255 defines a connected spring housing 256 for receiving the spring 210. A lower end of the spring 210 abuts a spacer bearing 265 that is adjacent to the spring housing 256. An upper end of the spring 210 abuts a lower end of the piston 205. The spring operates in compression to bias the piston 205 upward. Movement of the piston 205 from the upper position to the lower position compresses the biasing member 210 against the spacer bearing 265. In the arrangement of FIGS. 2 and 4, an annular shoulder 206 is provided as a connector between the piston 205 and the spring 210.

Disposed below the spacer bearing 265 is a flapper 220. The flapper 220 is rotationally attached by a pin 230 to a flapper mount 290. The flapper 220 pivots between an open position and a closed position in response to movement of a flow tube 225. A shoulder 226 is provided for a connection between the piston 205 and the flow tube 225. In the open position, a fluid pathway is created through the bore 260, thereby allowing the flow of fluid through the valve 200. Conversely, in the closed position, the flapper 220 blocks the fluid pathway through the bore 260, thereby preventing the flow of fluid through the valve 200.

Further illustrated in FIG. 2, a lower portion of the flow tube 225 is disposed adjacent the flapper 220. The flow tube 225 is movable longitudinally along the bore 260 of the housing 255 in response to axial movement of the piston 205. Axial movement of the flow tube 225, in turn, causes the flapper 220 to pivot between its open and closed positions. In the open position, the flow tube 225 blocks the movement of the flapper 220, thereby causing the flapper 220 to be maintained in the open position. In the closed position, the flow tube 225 allows the flapper 220 to rotate on the pin 230 and move to the closed position. It should also be noted that the flow tube 225 substantially eliminates the potential of contaminants, such as cement, from interfering with the critical workings of the valve 200. However, it is desirable that additional means be provided for preventing contact by cement with the flapper 220 and other parts of the valve 200, including the flow tube 225 itself. To this end, the valve 200 also includes a sleeve 215 which is disposed adjacent the housing 255.

Each of FIGS. 2–5 shows an isolation sleeve 215 adjacent to the bore 260 of the valve 200. The sleeve 215 serves to isolate the bore 260 of the valve from at least some operative parts of the valve 200. The sleeve 215 has an inner diameter and an outer diameter. The inner diameter forms a portion of the bore 260 of the valve, while the outer diameter provides an annular area 240 vis-à-vis the inner diameter of the tubular housing 255. Preferably, the sleeve 215 is press fit into the housing 255. An upper portion of the flow tube 225 is movably received within the annular area.

In one embodiment, a plurality of notches 295 may optionally be radially disposed at the lower end of the flow tube 225. The notches 295 are constructed and arranged to allow pressure communication between the bore 260 of the valve 200 and the annular area 240 inside the tubular housing 255. This, in turn, provides pressure balancing and helps prevent burst or collapse of the thin isolation sleeve 215 and the flow tube 235. Where notches 295 are employed, it is desirable that the notches 295 be small enough to discourage cement or particles from entering the bottom of the flow tube 225. It is preferred, however, that notches not be employed, but that the flow tube 235 be fabricated from a material sufficient to withstand anticipated burst and collapse pressure differentials between the bore 260 and the annular area 240. Similarly, it is preferred that the sleeve 215 also be fabricated from a material sufficient to withstand anticipated burst and collapse pressure differentials between the bore 260 and the annular area 240.

A seal ring 235 is preferably provided at an interface between the sleeve 215 and the movable flow tube 225. Preferably, the seal ring 235 is fixed along the outer diameter of the sleeve 215 at a lower end of the sleeve 215. The seal ilng 235 would then be stationary and the flow tube 225 would move through the seal ring 235. Alternatively, the seal ring 235 is placed in a groove in an upper end of the flow tube 225. In this respect, the movement of the piston 205 in response to the hydraulic pressure in the line 145 would also cause the seal ring 235 and flow tube 225 to move. In so moving, the seal ring 235 would traverse upon the outer diameter of the isolation sleeve 215.

Where a seal is provided, the isolation sleeve 215 fluidly seals an inside of the chamber housing 255. In an alternative embodiment, the sleeve 215 could be machined integral to the housing 255. The primary reason for the seal ring 235 is to prevent contaminants, such as cement, from entering into the annular area 240 adjacent the piston 205. Typically, the seal ring 235 creates a fluid seal between the flow tube 225 and the stationary sleeve 215.

Figure 3:
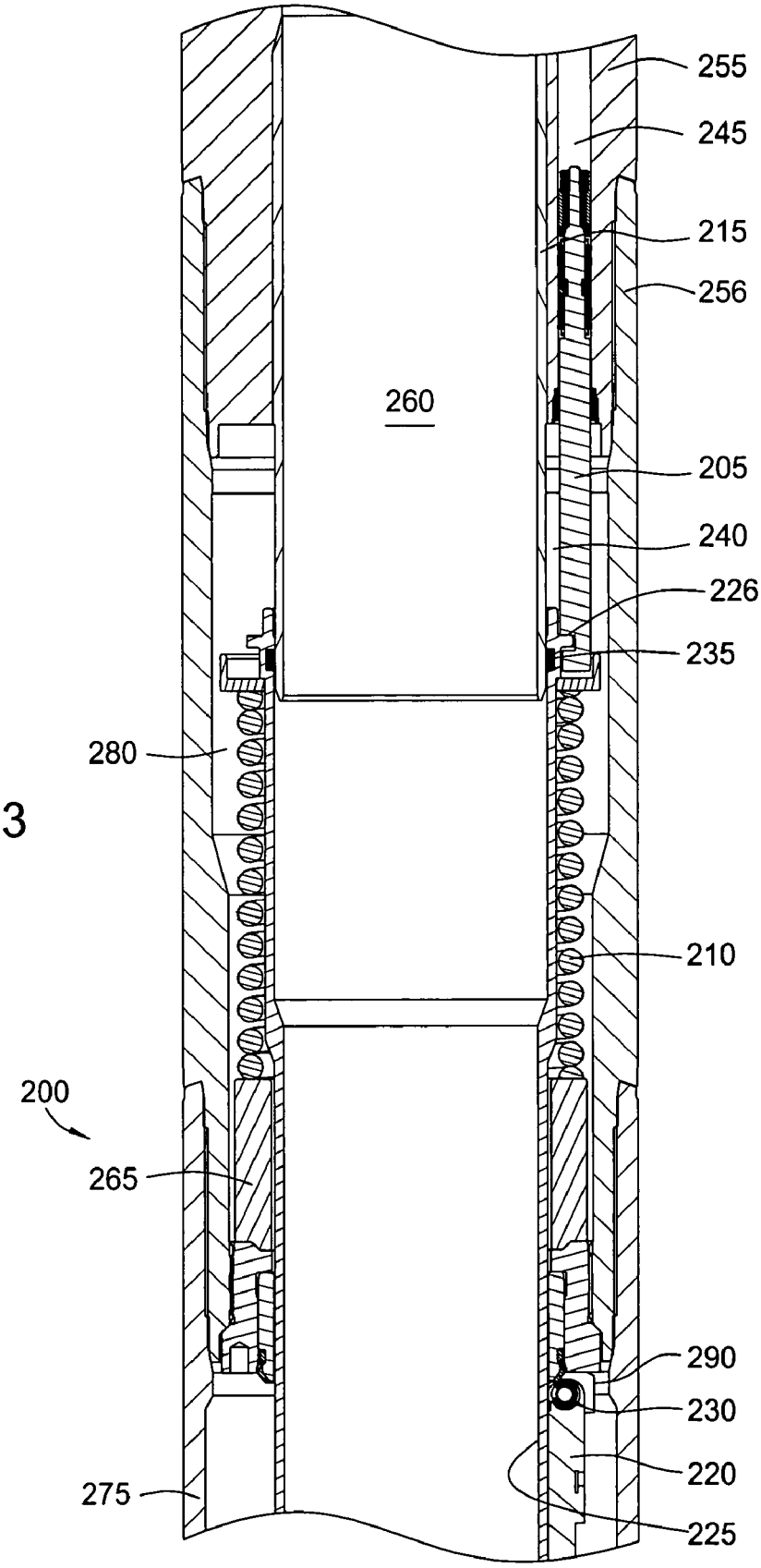
FIG. 3 is an enlarged cross-sectional view of the safety valve of FIG. 2. Again, the flow tube is positioned to maintain the safety valve in its open position.

FIG. 3 presents an enlarged cross-sectional view of a portion of the safety valve 200 of FIG. 2. The flow tube 225 is more visible here. Again, the flow tube 225 is positioned to maintain the safety valve 200 in its open position. This position allows cement or other fluids to flow down through the bore 260 during completion operations, and allows hydrocarbons to flow up through the bore 260 during production. In either case, the flow tube 225 also protects various components of the valve 200, such as the biasing member 210 and the flapper 220, from cement or contaminants that will flow through the bore 260. Furthermore, the flow tube 225 in the open position prevents the flapper 220 from moving from the open position to the closed position.

Typically, the flow tube 225 remains in the open position throughout the completion operation and later production. However, if the flapper 220 is closed during the production operation, it may be reopened by moving the flow tube 225 back to the open position. Generally, the flow tube 225 moves to the open position as the piston 205 moves to the lower position and compresses the biasing member 210 against the spacer bearing 265. Typically, fluid from the line (not shown) enters the chamber 245, thereby creating a hydraulic pressure on the piston 205. As more fluid enters the chamber 245, the hydraulic pressure continues to increase until the hydraulic pressure on the upper end of the piston 205 becomes greater than the biasing force 210 on the lower end of the piston 205. At that point, the hydraulic pressure in the chamber 245 causes the piston 205 to move to the lower position. Since the flow tube 225 is operatively attached to the piston 205, the movement of the piston 205 causes longitudinal movement of the flow tube 225 and the seal ring 235.

It is also noted that the flow tube 225 also may aid in providing isolation of fluids from the annular area 240. In this respect, the bottom of the flow tube 225 is dimensioned to land on a shoulder of the lower sub 275 when the flow tube 225 is moved to the open position (seen in FIG. 2). An elastomeric seal member (not shown) may be provided at the bottom of the flow tube 225 to engage the lower sub 275. Preferably though, a seal member is provided along a shoulder of the sub 275 to meet the bottom of the flow tube 225 in the valve's 200 open position.

FIG. 4 is a cross-sectional view illustrating the tubing-retrievable safety valve 200 of FIG. 2 in its closed position. Generally, in the production operation, fluid flow through the production tubing may be controlled by preventing flow through the valve 200. More specifically, the flapper 220 seals off the bore 260, thereby preventing fluid communication through the valve 200.

During closure, fluid in the chamber 245 exits into the line 145, thereby decreasing the hydraulic pressure on the piston 205. As more fluid exits the chamber 245, the hydraulic pressure continues to decrease until the hydraulic pressure on the upper end of the piston 205 becomes less than the opposite force on the lower end of the piston 205. At that point, the force created by the biasing member 210 causes the piston 205 to move to the upper position. Since the flow tube 225 is operatively attached to the piston 205, the movement of the piston 205 causes the movement of flow tube 225 and the seal ring 235 into the annular area 240 until the flow tube 225 is substantially disposed within the annular area 240. In this manner, the flow tube 225 is moved to the closed position.

Figure 5:
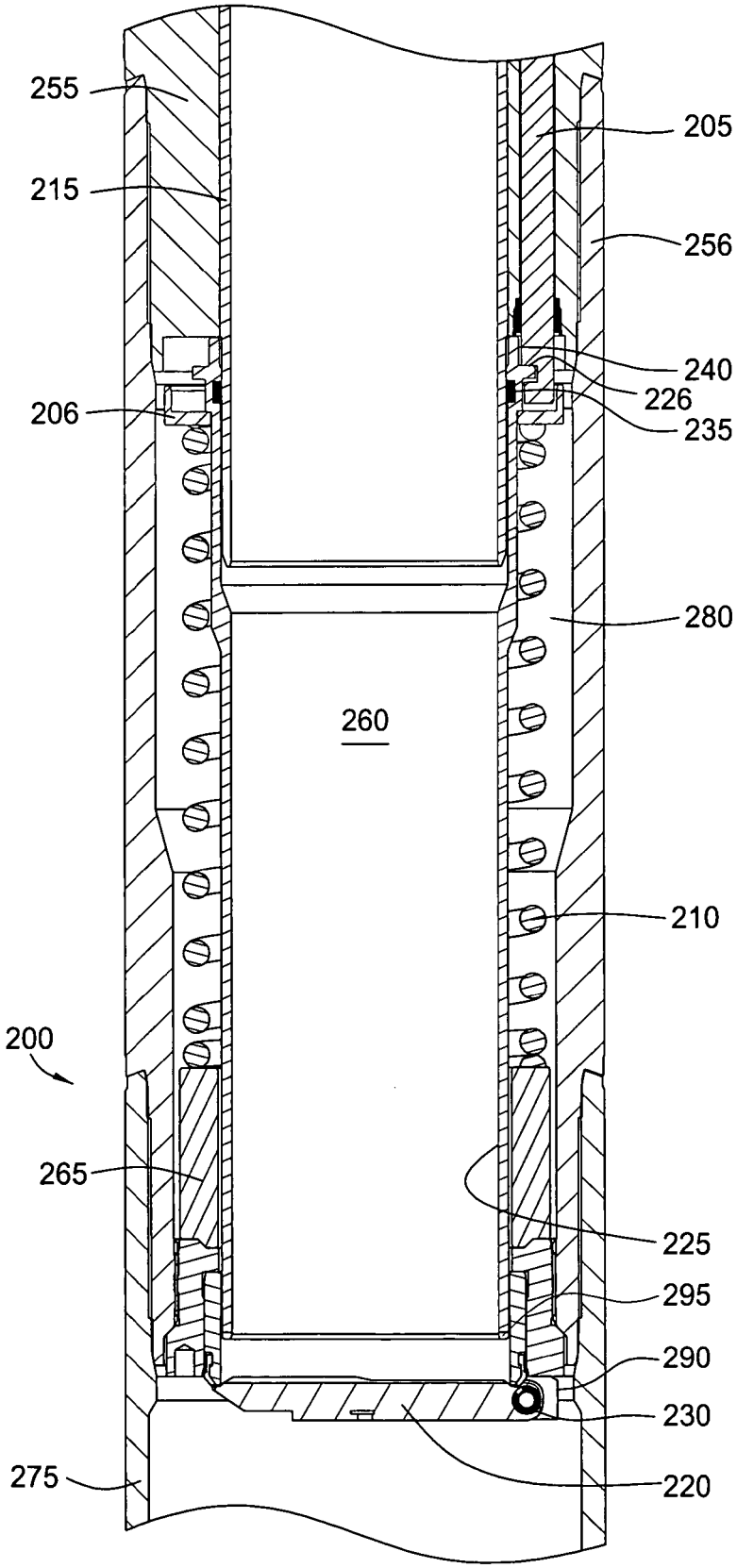
FIG. 5 is an enlarged cross-sectional view of the safety valve of FIG. 4. The flow tube is again positioned to maintain the safety valve in its closed position.

FIG. 5 is an enlarged cross-sectional view illustrating the flow tube 225 in the closed position. Here, the piston 205 is raised within the chamber 245. In this respect, the spring 210 of FIG. 5 is seen expanded vis-à-vis the spring 210 of FIG. 3. This indicates that the biasing action of the spring 210 has overcome the piston 205. As the piston 205 is raised, the connected flow tube 225 is also raised. This moves the lower end of the flow tube 225 out of its position adjacent the flapper 220. This, in turn, allows the flapper 220 to pivot into its closed position. In this position, the bore 260 of the valve 200 is sealed, thereby preventing fluid communication through the valve 200. More specifically, flow tube 225 in the closed position no longer blocks the movement of the flapper 220, thereby allowing the flapper 220 to pivot from the open position to the closed position and seal the bore 260.

Although the invention has been described in part by making detailed reference to specific embodiments, such detail is intended to be and will be understood to be instructional rather than restrictive. It should be noted that while embodiments of the invention disclosed herein are described in connection with a subsurface safety valve, the embodiments described herein may be used with any well completion equipment, such as a packer, a sliding sleeve, a landing nipple and the like.

While the foregoing is directed to embodiments of the present invention, other and further embodiments of the invention may be devised without departing from the basic scope thereof, and the scope thereof is determined by the claims that follow.

The invention claimed is:

1. A downhole apparatus having a bore there through, comprising:

a tubular housing;

a tubular isolation sleeve disposed within an inner diameter of the tubular housing, the isolation sleeve and the tubular housing forming an annular area there between;

a lower sub connected to the housing;

a flow tube movably disposed along a portion of an outer diameter of the isolation sleeve;

a flapper, the flapper being pivotally movable between an open position and a closed position in response to the longitudinal movement of the flow tube; and a seal ring provided at an interface between the isolation sleeve and the flow tube for providing the isolation of the annular area, wherein a bottom of the flow tube directly lands on a shoulder in the lower sub when the flapper is in the open position, thereby further isolating the annular area.

2. The apparatus of claim 1, wherein the seal ring is placed along an inner diameter of the flow tube.

3. The apparatus of claim 1, wherein the annular area is isolated from the bore in the open position.

4. The apparatus of claim 1, wherein the seal ring is placed along an cuter diameter of the isolation sleeve for sealingly receiving the movable flow tube.

5. The apparatus of claim 1, wherein a plurality of notches are radially disposed in the bottom of the flow tube and the notches are configured to discourage cement from entering the bottom of the flow tube.

6. The apparatus of claim 1, wherein the apparatus permits fluid to flow through the bore when the flapper is in the open position.

7. The apparatus of claim 1, further comprising:

a piston disposed in a chamber above the flow tube, wherein the piston acts against the flow tube in response to hydraulic pressure in order to move the flow tube longitudinally.

8. The apparatus of claim 7, further comprising:

a biasing member acting against the piston in order to bias the piston and connected flow tube to allow the flapper to close.

9. The apparatus of claim 8, wherein the piston is a rod piston.

10. A method for using the apparatus of claim 1 in a wellbore, comprising the steps of:

placing the apparatus of claim 1 in series with a string of production tubing, the production tubing having a born there through;

running the production tubing and the apparatus into the wellbore;

placing the flapper in its open positional; and pumping cement into the bore of the production tubing and through the apparatus.

11. A method for controlling fluid flow in a wellbore, comprising the steps of:

placing a safety valve in series with a string of production tubing, the production tubing having a born there through, and the safety valve comprising:

a tubular housing;

a tubular isolation sleeve disposed within an inner diameter of the tubular housing, the isolation sleeve and the tubular housing forming an annular area there between;

a flow tube movably disposed along a portion of the annular area; and a flapper, the flapper being pivotally movable between an open position and a closed position in response to the longitudinal movement of the flow tube;

running the production tubing and safety valve into the wellbore;

placing the flapper in its open position; and pumping cement into the bore of the production tubing and through the safety valve into an annulus formed between the production tubing and the surrounding wellbore to form a cement column, thereby securing the production tubing in the wellbore;

providing fluid communication between the bore of the tubing and a selected formation along the wellbore; and producing the well by allowing hydrocarbons to flow through the production tubing and the opened safety valve.

12. The method of 11, further comprising the step of:

placing the flapper in its dosed position.

13. The method of claim 11, wherein the step of providing fluid communication between the bore of the tubing and the selected formation along the wellbore comprises:

running a perforating gun into the bore of the production tubing proximate the desired formation; and activating the perforating gun, thereby forming a plurality of perforations in a wall of the production tubing and through the surrounding cement column.

14. The method of claim 13, wherein the step of providing fluid communication between the bore of the tubing and a selected formation along the wellbore further comprises:

removing the perforating gun from the wellbore.

15. The method of claim 11, wherein the annular area is isolated from the bore.

16. The method of claim 15, wherein the valve further comprises a seal ring provided at an interface between the isolation sleeve and the flow tube for providing the isolation of the annular area.

17. The method of claim 16, wherein the seal ring is placed along an outer diameter of the isolation sleeve for sealingly receiving the movable flow tube.

18. The method of claim 16, wherein the seal ring is placed along an inner diameter of the flow tube.

19. The method of claim 11, wherein:

the valve further comprises a piston disposed above the flow tube, wherein the piston acts against the flow tube in response to hydraulic pressure in order to move the flow tube longitudinally; and the step of placing the flapper in its open position comprises actuating the piston to act against the flow tube so as to permit fluid to flow through the inner diameter of the isolation sleeve.

20. The method of claim 19, wherein the piston is a rod piston.

21. The method of claim 20, wherein the flow tube is connected to the rod piston and the valve further comprises a biasing member acting against the rod piston in order to bias the rod piston and connected flow tube to allow the flapper to close.

22. A downhole apparatus having a bore there through, comprising:

a tubular housing having an inner portion, an outer portion, and an annular area formed between the inner and outer portions;

a lower sub connected to the housing;

a flow tube movably disposed along a portion of an outer diameter of the inner portion of the housing; and a flapper, the flapper being pivotally movable between an open position and a closed position in response to the longitudinal movement of the flow tube; and a seal ring provided at an interface between the housing and the flow tube for providing the isolation of the annular area wherein a bottom of the flow tube directly lands on a shoulder in the lower sub when the flapper is in the open position, thereby further isolating the annular area.

23. The apparatus of claim 22, wherein the annular area is isolated from the bore in the open position.

24. The apparatus of claim 22, wherein the seal ring is placed along an outer diameter of the inner portion of the housing for sealingly receiving the movable flow tube.

25. The apparatus of claim 22, wherein a plurality of notches are radially disposed in the bottom of the flow tube and the notches are configured to discourage cement from entering the bottom of the flow tube.

26. The apparatus of claim 22, wherein the valve permits fluid to flow through the bore when the flapper is in the open position.

27. The apparatus of claim 22, further comprising:

a piston disposed in a chamber above the flow tube, wherein the piston acts against the flow tube in response to hydraulic pressure in order to move the flow tube longitudinally.

28. The apparatus of claim 27, further comprising:

a biasing member acting against the piston in order to bias the piston and connected flow tube to allow the flapper to close.

29. The apparatus of claim 28, wherein the piston is a rod piston.

30. The apparatus of claim 22, wherein the seal ring is placed along an inner diameter of the flow tube.

31. A method for using the apparatus of claim 22 in a wellbore, comprising the steps of:

placing the apparatus of claim 23 in series with a string of production tubing, the production tubing having a bore there through;

running the production tubing and the apparatus into the wellbore;

placing the flapper in its open position; and pumping cement into the bore of the production tubing and through the apparatus.

* * * * *

UNITED STATES PATENT AND TRADEMARK OFFICE

CERTIFICATE OF CORRECTION

PATENT NO. : 7,314,091 B2
APPLICATION NO. : 10/853568
DATED : January 1, 2008
INVENTOR(S) : Wagner et al.

It is certified that error appears in the above-identified patent and that said Letters Patent is hereby corrected as shown below:

In the Claims:

Column 8, Claim 4, Line 36, please delete “cuter” and insert --outer--;

Column 8, Claim 10, Line 59, please delete “born” and insert --bore--;

Column 8, Claim 10, Line 63, please delete “positional” and insert --position--;

Column 9, Claim 11, Line 2, please delete “born” and insert --bore--;

Column 9, Claim 12, Line 28, please delete “dosed” and insert --closed--;

Column 10, Claim 31, Line 52, please delete “23” and insert --22--.

Signed and Sealed this

First Day of July, 2008

JON W. DUDAS
*Director of the United States Patent and Trademark Office*